US006572111B1

(12) United States Patent
Samberg

(10) Patent No.: US 6,572,111 B1
(45) Date of Patent: Jun. 3, 2003

(54) SYSTEM FOR PLAYING DUPLICATE GIN RUMMY GAMES, SCORING AND HANDICAPPING GAMES AND AWARDING POINTS ON OUTCOME OF GAMES

(76) Inventor: Charles Samberg, 4220 Fox Trace, Boynton Beach, FL (US) 33436

( * ) Notice: Subject to any disclaimer, the term of this patent is extended or adjusted under 35 U.S.C. 154(b) by 0 days.

(21) Appl. No.: 10/073,891

(22) Filed: Feb. 14, 2002

(51) Int. Cl.[7] ..... A63F 1/00
(52) U.S. Cl. ..... 273/292; 273/274
(58) Field of Search ..... 273/292, 303, 273/305, 274; 463/13

(56) References Cited

U.S. PATENT DOCUMENTS

| | | | | | |
|---|---|---|---|---|---|
| 3,689,071 | A | * | 9/1972 | Kucera | 273/281 |
| 3,777,410 | A | * | 12/1973 | Robinson | 434/323 |
| 4,219,197 | A | * | 8/1980 | Acuff | 273/299 |
| 4,230,321 | A | * | 10/1980 | Smith | 273/308 |
| 4,314,336 | A | | 2/1982 | Bernstein et al. | |
| 4,886,272 | A | * | 12/1989 | Adise | 273/148 R |
| 4,900,027 | A | * | 2/1990 | Sheridan | 700/92 |
| 4,968,030 | A | * | 11/1990 | Frymire | 463/44 |
| 5,380,012 | A | | 1/1995 | Jones et al. | |
| 5,486,005 | A | * | 1/1996 | Neal | 273/292 |
| 5,601,488 | A | * | 2/1997 | Kadlic | 463/13 |
| 5,816,576 | A | * | 10/1998 | Aramapakul et al. | 273/292 |
| 5,853,325 | A | * | 12/1998 | Kadlic | 463/13 |
| 6,174,237 | B1 | * | 1/2001 | Stephenson | 463/42 |
| 6,257,581 | B1 | | 7/2001 | New | |

OTHER PUBLICATIONS

Roger M. Snow—Method Of Playing A Three–Part Wagering Game With Bonus For Consecutive Wins—Mar. 6, 2003—Pub No.: US 2003/0042679 A1.*
Roger M. Snow—Method Of Playing A Three Part Wagering Game—Aug. 22, 2002—Pub No.: US 2002/0113371 A1.*

* cited by examiner

*Primary Examiner*—Benjamin H. Layno
*Assistant Examiner*—Dolores R. Collins
(74) *Attorney, Agent, or Firm*—Hoffman, Wasson & Gitler

(57) ABSTRACT

A plurality of pairs of players play hands of Gin Rummy with identically arranged decks of cards. Each round of play usually consists of one to three hands. At the conclusion of a round, players are rotated until every first player of a pair has played every second player of a pair. For each hand, a winner is determined and points are awarded. At the conclusion of all rounds, players are ranked by their score to determine a winner. The top 40% of winners receive Gin Points which are accumulated over time to achieve levels. Games can be conducted by differentiating players by the winning average achieved or by providing each player with a handicap. The handicap is the difference between a player's average score and a percentage of the maximum points possible for the game.

15 Claims, No Drawings

SYSTEM FOR PLAYING DUPLICATE GIN RUMMY GAMES, SCORING AND HANDICAPPING GAMES AND AWARDING POINTS ON OUTCOME OF GAMES

FIELD OF THE INVENTION

The invention relates to a system for organizing Gin Rummy card games using multiple pairs of players, each game using a duplicately arranged deck, scoring the winner of individual matches, calculating a handicap for each player and awarding points based on the outcome of the game.

BACKGROUND OF THE INVENTION

Gin Rummy is one of the most popular forms of rummy. The game is generally played by two players, each receiving ten cards. One standard deck of 52 cards is used. Cards in each suit rank, from low to high: Ace, 2, 3, 4, 5, 6, 7, 8, 9, 10, Jack, Queen, King.

| | |
|---|---|
| Face cards (K, Q, J) | 10 points |
| Ace | 1 point |

The players are listed as North and South. All odd numbered deals are dealt by North and all even numbered deals are dealt by South. Each player is dealt ten cards, one at a time. The 21st card is turned face up to start the discard pile and the remainder of the deck is placed face down beside it to form the stock. The players look at and sort their cards.

The object of the game is to arrange as many as possible of the ten cards in your hand into sets. There are two kinds of sets: sequences and groups. A sequence consists of three or more cards of the same suit in consecutive order, such as 4 of clubs, 5 of clubs and 6 of clubs or 8 of hearts, 9 of hearts 10 of hearts and jack of hearts. A group is three or four cards of the same rank, such as 7 of diamonds, 7 of hearts and 7 spades. A card can belong to only one set at a time—you cannot use the same card as part of both a group and a sequence.

A normal turn consists of two parts: the draw and the discard.

The Draw

You must begin by taking one card from either the top of the stock pile or the top card on the discard pile, and adding it to your hand. The discard pile is face up, so you can see in advance what you are getting. The stock is face down, so if you choose to draw from the stock you do not see the card until after you have committed yourself to take it. If you draw from the stock, you add the card to your hand without showing it to the other players.

The Discard

To complete your turn, one card must be discarded from your hand and placed on top of the discard pile face up. If you took the top card from the discard pile, you must discard a different card—taking the top discard and putting the same card back is not permitted.

For the first turn of the hand, the draw is done in a special way. First, the person who did not deal chooses whether to take the turned up-card. If the non-dealer declines it, the dealer may take the card. If both players refuse the turned-up card, the non-dealer draws the top card from the stock pile. Whichever player took a card completes their turn by discarding and then it is the other player's turn to play.

The play ends when a player knocks or goes Gin. The rules of play in this game on knocking is as follows. The value of the original face up card determines the maximum count of unmatched cards when it is possible to knock. Pictures denote ten as usual. So if a 7 is turned up, in order to knock, you must reduce your count to seven or fewer. If the original face up card is a spade, the final score for that deal, including any bonus, is doubled. If an ace is the first turned up card, you must go for Gin. Knocking, or going Gin, can be done on any turn (including a player's first turn), immediately after drawing, provided that you can form a sufficient number of your cards into sets. Having knocked, you complete your turn by discarding one card as usual and then spreading your remaining cards face up on the table, arranged as far as possible into groups and sequences. Any remaining cards from your hand which are not part of a set are called unmatched cards or deadwood. In order to be allowed to knock, the total value of your unmatched cards must be less then the knock card that was turned face up at the start of the hand. If you have no unmatched cards, that is called going Gin, and earns a special bonus.

A player is never forced to knock. A player who is able to knock may choose instead to carry on playing, to try to get Gin with a better score.

The opponent of the player who knocked must then spread their cards face-up, arranging them into sets where possible. Provided that the knocker did not go Gin, the opponent is also allowed to lay off any unmatched cards by using them to extend the sets laid down by the knocker—by adding a fourth card of the same rank to a group of three, or further consecutive cards of the same suit to either end of a sequence.

If a player goes Gin, the opponent is not allowed to lay off any cards. The knocker is never allowed to lay off cards on the opponent's sets.

The play also ends if the stock pile is reduced to two cards, and the player who took the third last card discards without knocking. In this case the hand is cancelled, there is no score. If one player knocks and the counts of the unmatched cards of the knocker is higher than the opponent, the knocker has been undercut. In this case, the knocker's opponent scores the difference between the counts, plus a ten point bonus. If a player knocks and the opponent, after laying off, has no points left in their hand, this is called a gin-off. In that case, the player who Ginned-off gets the number that the knocker has in unmatched cards plus a bonus of 20 points. If the knocked card was a spade, the score is doubled.

A player who goes Gin scores a bonus 25 points, plus the opponent's count in unmatched cards, if any. A player who goes Gin can never be undercut. Even if the other player has no unmatched cards at all, the player who got Gin gets the 25 point bonus the other player scores nothing.

As used in the specification and claims, the term Gin Rummy has the meaning as understood by one of ordinary skill in the art, with all its known variations.

It is the object of the invention to provide a system for conducting Gin Rummy card games with simultaneous games being played, each game played with a duplicately arranged deck.

It is another object of the invention to provide a system for scoring outcome of each individual hand in a game based on match points.

It is another object of the game to provide each player with a handicap based on a player's average score and a percentage of the maximum available points.

It is yet another object of the invention to provide a system for awarding points to the winners of the game based on the final score of the game.

It is yet another object of the invention to provide games where players are stratified based on winning average.

It is yet another object of the invention to establish winning averages which are similar to a baseball player's batting average.

SUMMARY OF THE INVENTION

A duplicate Gin Rummy game consists of several tables with two players at each table or over the Internet. The chairs at each table will be designated in a way such as North and South. The Gin Rummy game begins with each table starting out with identically arranged decks of cards so that each North player and each South player begin with identical hands. The hands are played until their conclusion at which time the hands are scored. Two or three hands will be played in each round, with a new, identically arranged deck used for each hand. At the end of a round, the South players will be rotated. South #1 will move to North #2, South #2 will move to North #3, South #10 (if there are ten tables) will move to North #1. If there are ten tables, there will be three hands per round and ten rounds to complete the game. In this case, all South players will play all North players. Each hand will be scored separately using total points. At the end of the game, the total points will be converted to match points.

The score for the game is calculated. The score will be based on the total number of points, then converted to Match Points. In such a system, the winner of each individual hand is awarded a number of Match Points. The individual North player and individual South player with the most Match Points is designated as winning the game.

Winners of the game are awarded points, designated as Gin Points, for winning the game or games. Players accumulate Gin Points by winning points in individual games. Levels of accomplishment are established based on the number of individual Gin Points. The different levels can be given any designation such as A Level, B Level, C Level. In this way, games can be conducted with players of all levels and winners are determined only by counting players on similar levels.

A handicap system can be deployed giving each player a point total added to their score based on the difference between their average points and a percentage of the total points available in a game. In this way, a player using their handicap can compete against players of greater skill and experience on a somewhat level playing field.

DETAILED DESCRIPTION OF THE INVENTION

A Gin Rummy game is conducted with a plurality of tables. Each table has two players which, for clarity purposes, we will designate as North and South. A computer does a random shuffle and transmits this information to an electronic card sorter and places whatever number of decks that are necessary on whatever number of tables for whatever number of players that are planning to play. In the Internet version of this game, the computer will do a random shuffle and display identical decks on the screens of all those who are planning to play. Of course, identically arranged decks can be prepared manually, but, especially in large games, this approach would be time consuming and impractical. When the initial hand is dealt to the North and South players, all of the North players and all of the South players will have identical hands.

The game is played between the North and South players until completion. After all of the tables have completed their round, the players are rotated until each North player has played each South player to complete the game. It is important to use identically arranged decks and to have each North player play each South player because although North players oppose their South player opponents, they are being scored against the other north players. North players compete only against each other and the South players also compete only against each other.

The game concludes when all rounds have been played. Approximately thirty hands are played to complete the game. With ten tables, each North player plays each South player three times. With fourteen players, they will be made into two sections of seven tables each and play four hands per round for seven rounds, therefore playing 28 hands, but North will still play all South players. At the conclusion of the game, a score for each hand is calculated and then match pointed. Match points prevents one bad game by a player resulting in enough points for his opponent that the number of points lost makes it difficult, if not impossible, for that player to overcome the loss and give them a chance of winning. In this way, one hand will not determine the outcome of the game. It is possible to get Gin and catch the opponent with 98 points. With a bonus of 25 points for going Gin, one player can accumulate 123 points for the one hand. If we add spades as the 21st card, this could amount to 246 points for one hand.

To calculate match points, the number of pairs in the field of the game is subtracted by one to arrive at a point total. For ten pairs of players, the top score for a hand would be nine. At the conclusion of each game between pairs, the highest North score is awarded nine and the remaining players are given the next sequential number until the lowest North score receives zero. If the North player receives nine points, his opponent, the South player, receives zero. If two players are tied for a score, the points for those two places are combined and then halved. In this instance, if two players were tied for the top score, the available points of nine and eight would be combined and divided between the two so that each player received eight and one half points. At the conclusion of the game, the Match points accumulated by a player are tallied and the North players and South players are ranked separately by total Match points. With thirty hands being the standard number of hands played, the usual highest possible score is 270.

Winners of the games are awarded Gin Points which are accumulated over time. The number of Gin Points awarded for winning or placing in a game is determined as follows: One tenth of a Gin Point is designated for each table in the game. If ten tables were playing, there would be one tenth, times ten, equals one Gin Point. If 15 tables were playing, one tenth, times 15, equals 1.5 Gin Points. One tenth of a point for each table in the same section. Forty percent of the North players and 40% of the South players in the game receive some number points. The North player who comes in first and the South player that comes in first in a ten table game, each receive one full Gin Point, second place for North and South receive 0.50 point, third gets 0.25, and fourth gets 0.13 Gin Points. If two or more players tie, the points for their two place finishes are added and split between the players. Awarded points are rounded up to the nearest whole number. Since 40% of the players receive points, it is best to have the number of tables being a multiple of five. If the number of tables is not a multiple of five, the number of tables is multiplied by 0.4 and rounded to the nearest whole number. For instance, if 14 pairs were in the game, the number 14 is multiplied by 0.4 and the results, 5.6 is rounded up to six, and the top six North and South players receive points. If 13 pairs were playing, 13 is multiplied by 0.4 and the result, 5.2 is rounded to five, and the top five players receive points.

Points are accumulated over time and several levels are achieved by accumulating these points over time. In addition to accumulating points for games, points earned at more competitive tournaments (multiple games), are granted special favor. These points are designated with a color to result in a pigmented points system. Points won at a local game or the Internet are black, those at sectionals are black and silver, regionals are designated as black and gold, and nationals black, gold and platinum. Points won at year end eliminations would be designated diamond. Certain levels based on accumulated points will require certain pigmented points in addition to total points. In the preferred embodiment, a rookie will have 0–5 points of any color, a novice player will have 5–20 points of any color, a junior Master will have 20–50 points of any color, a club Master will have 50–100 points of any color. A sectional Master will need up to 200 points of which 25 will be silver, a regional Master will require up to 250 points of which 25 will be silver, 25 gold. A national Master will have 300 points of which 25 are platinum, 25 are gold and 25 are silver. A Grand Master, the highest level, will require 500 points and five diamond points, 25 platinum points, 25 gold points and 25 silver points.

Although the accumulation of points and the levels of achievement that are won show some level of expertise, the winning average that a player is credited with will be used to designate the various stratified levels that a player may participate in. Under this system, in a large game, players at the lowest level can complete against players at the highest level yet be scored against players at their same level. In a large game there will be players of different ability, it will be possible for players to compete against others at the same level of ability, or play in open game against one another. At the conclusion of a game, all players are ranked. Under this initial ranking, players of the highest level compete not only against like players, but also against players of a lower level. A secondary scoring lists all players except those at the highest level. This scoring continues until only the players at the lowest level are ranked by themselves.

Under such a system, a player in a lower level is able to earn points if, at that game, they earn a better score than players at a higher level.

In an example of how an open game operates, suppose a game is conducted with 15 total pairs with the North players, ranked against each other, not against the South players. If there are five players in strat A, five players in strat B, and five players in strat C. At the conclusion of the game, the 15 players are ranked sequentially from top to bottom. For the highest strat, all 15 players are ranked and 40%, six players, receive Gin Points. These points are awarded to the top six players over all, regardless of strat. The top four players of the ten players not in the highest stratification are ranked separately with four of those players, 40% of the ten players, receiving Gin Points. Lastly, the five players in the lowest stratification are ranked with the top two players receiving Gin Points based on the five players qualifying in this stratification. In this way, players can earn points in a higher stratification, but not in a lower stratification.

With the larger number of players being ranked in the upper strat, one and one half Gin Points are available for first place whereas in the second stratification, with only ten players being considered, one Gin Point is available and in the lowest stratification, with only five players competing, one half Gin Point is available. If a player earns points in more than one stratification, they are able to choose whichever point total is higher. In this instance, a B player winning the overall game will finish first in the overall standing, and also first overall when the B level is ranked. Having earned one and one half points for the A stratification and 1 point in the B stratification, that player would receive the higher total, one and one half points.

Another method to provide a level playing field between players of different abilities is to use a handicapping system within a handicapped game. Under a handicap system, a player has points added to his score based on that player's average score and a percentage of the maximum number of points possible in a game. For instance, 270 points is the usual maximum score based on 30 hands with ten players, making nine points the maximum value per hand. If an average player would have scored 135 points, a handicap can be calculated as the difference between that player's average score and a percentage of the maximum score. In the preferred embodiment, the percentage of the maximum score is 60% since the top 40% of the players earn points. In the above-mentioned example, a player having an average score of 135 out of 270 would have a handicap of 27 calculated as 60% of 270 minus 135. If a game is played with other than 30 hands, the handicap can be changed proportional to the difference between the standard 270 maximum points and the maximum number of points available in that particular game.

The system of the invention provides for conducting duplicate Gin Rummy games with multiple pairs. The scoring of individual matches is tallied and based on the scores for each individual player during game, players are ranked and Gin Points are awarded. Gin Points are accumulated over time and different levels of accomplishment are achieved. The different levels of winning averages allow for stratified games. An alternative to stratified games is to provide each player with a handicap so that players of different abilities can complete on a somewhat level playing field. With the use of Gin Points won, a winning average as well as a handicap system, players of every level and ability can play and have a reasonable expectation of winning some number of points.

Variations and modifications of the invention would be apparent to one of ordinary skill in the art. The number of Match Points awarded for play between pairs and Gin Points awarded to the winners of a game could be altered without deviating from the spirit and scope of the invention. The invention covers variations and modifications which would be apparent to one of ordinary skill in the art.

I claim:

1. A system for conducting a Gin Rummy game, comprising:

a plurality of first pairs, each pair comprising a first player and a second player, each first pair playing at least one hand of Gin, with each pair playing with identically arranged decks of cards, rotating players so that each first player is paired with a different second player, to comprise second pairs, each second pair playing at least one hand of Gin, with each pair playing with an identically arranged deck of cards, continuing to rotate players to form new pairs and play at least one hand of Gin, until a plurality of hands have been played, tallying a Gin hand score for all first players and tallying a Gin hand score for all second players, and the game score based on all hands played.

2. The system of claim 1, wherein said plurality of hands is 30.

3. The system of claim 1, wherein the plurality of first pairs is ten, each first player plays each second player three hands.

4. The system of claim 1, further comprising:

ranking all first players according to the game score, ranking all second players according to the game score, and awarding Gin Points to the top first players and the top second players.

5. The system of claim 4, wherein Gin Points are awarded to the top 40% of first players and top 40% of second players.

6. The system of claim 4, wherein the top players of the first players and second players receive one tenth point for each pair in the game.

7. The system of claim 6, wherein every subsequent player after the top player receives half the points earned by the next best player.

8. The system of claim 4, wherein points are given a designation varying with the level of difficulty of the game.

9. The system of claim 4, wherein points are accumulated and players achieve levels based upon the accumulated points.

10. The system of claim 9, wherein games having players of different levels, having a ranking for each level with players of similar and lower levels together.

11. The system of claim 10, wherein a player scoring points in several level rankings receives the highest point total of the levels.

12. The system of claim 1, further comprising calculating a handicap for each player, the handicap being the difference between the player's average score and a percentage of the maximum score for the game.

13. The system of claim 12, wherein the percentage of the maximum score is 60%.

14. The system of claim 1, wherein a winner of a hand wins nine points toward the game score.

15. The system of claim 1, wherein all first players play at least one hand of Gin against all second players.

* * * * *